United States Patent [19]

Guo

[11] 4,170,160

[45] Oct. 9, 1979

[54] ELECTRONIC MUSICAL INSTRUMENT

[76] Inventor: Jong Guo, 908 Beachpoint Way, Rodeo, Calif. 94572

[21] Appl. No.: 914,059

[22] Filed: Jun. 9, 1978

[51] Int. Cl.[2] ..... G10H 5/06; G10H 5/10

[52] U.S. Cl. ..... 84/1.01; 84/DIG. 8; 84/DIG. 20

[58] Field of Search ..... 84/1.01, DIG. 8, DIG. 20

[56] References Cited

U.S. PATENT DOCUMENTS

| | | | |
|---|---|---|---|
| 3,598,892 | 8/1971 | Yamashita | 84/1.01 |
| 3,806,623 | 4/1974 | Yamada | 84/1.01 |
| 3,828,108 | 8/1974 | Thompson | 84/1.01 |
| 3,872,764 | 3/1975 | Munch, Jr. et al. | 84/1.01 |
| 3,880,039 | 4/1975 | Studer | 84/1.01 |
| 3,906,830 | 9/1975 | Mathias | 84/1.01 |
| 3,948,137 | 4/1976 | Niinomi | 84/1.01 |
| 3,949,639 | 4/1976 | Adachi | 84/DIG. 20 |
| 3,991,645 | 11/1976 | Luce et al. | 84/1.01 |
| 4,077,293 | 3/1978 | Uchiyama | 84/1.01 |
| 4,136,595 | 1/1979 | Gillette | 84/1.01 |

*Primary Examiner*—Stanley J. Witkowski
*Attorney, Agent, or Firm*—Phillips, Moore, Weissenberger, Lempio & Majestic

[57] ABSTRACT

An electronic musical instrument includes a linear voltage divider network including a plurality of equal series resistance elements for generating a first output voltage as a function of the state of a plurality of tone select keys. This first voltage is converted to a second voltage which selectively varies exponentially as a function of the selected tone. The second voltage is compared with a ramp generator output to set and reset a latch which generates an audio frequency signal thereby. The audio frequency signal is coupled to an octave generator controlled by octave select keys for outputting the tone in a selected octave for output as sound via a speaker. Sharp and flat keys are also provided to cause the first voltage to vary in a way which emulates the functioning of a standard keyboard.

10 Claims, 6 Drawing Figures

ELECTRONIC MUSICAL INSTRUMENT

BACKGROUND OF THE INVENTION

Conventional electronic musical instruments have typically had either a conventional piano-key keyboard, including a switch actuation for each said key to manually select a given tone, or such instruments have included a lesser number of keys which require a combination of keys to be pressed at a single time to manually select a given tone. None are known to exist wherein separate keys are provided to manually select a given sharp or flat tone and wherein tone selects keys only select the seven major tones in a standard octave interval.

Prior art non-keyboard musical instruments have also been limited in the extent to which different octave levels can be manually selected, to provide modification of the frequency of the generated tone in a simple way, and to thereby enable production of a frequency in the selected octave range.

Further, in portable non-keyboard instruments, selection of a given octave for the selected tone has also been generally either non-existent, or primitive.

Further, prior art musical instruments have used either a series of resistance elements wherein each have a different value which must be specially chosen so that the proper exponential output voltage can be generated, to thereby generate the proper frequency spacing between adjacent tones, or prior art devices have included complex and cumbersome means for generating an exponentially variable voltage from a linear voltage generated by a standard series circuit containing resistance elements of equal value.

SUMMARY OF THE INVENTION

The present invention provides tone select key means including three keys for selection of one of seven major tones in a standard octave interval, and a sharp and a flat key for selecting the rest of the twelve tones in the octave. A plurality of resistance elements of equal value are connected in series for the purpose of generating a first voltage at a selected junction between adjacent resistance elements. This junction is selected in response to the state of the tone select keys by means of analog switch means. The analog switch means causes the voltage at said selected junction between adjacent resistors in said string to be output thereby. Also included are means for modifying the selected junction voltage as a function of manual selection of the sharp or flat key, such that a voltage representing respectively the next higher or lower tone is output as said first voltage. Means are provided for generating a second voltage as a function of said first voltage, said second voltage being exponentially variable as a function of the linear variation of the level of the first voltage. Means are also provided for generating an audio frequency signal as a function of the level of said second voltage. An octave generation means, under the control of a plurality of manually selectable octave select keys, causes said audio frequency to be divided by two, one or more plurality of times, such that the audio frequency signal coupled to a speaker means is in the selected octave range.

The voltage divider network further includes means for inhibiting the output tone when none of the tone select keys are manually selected. Further, a pause key means is provided to enable manual interruption of the sound signal without varying the state of said tone select keys or said sharp or flat key.

Therefore, a principal object of the present invention is to provide an electronic musical instrument wherein only a small plurality of keys are required to simply and easily select a given tone in an octave interval, and to further select a desired octave interval for said tone.

Another object of the present invention is to provide an electronic musical instrument wherein resistances of equal value are used, to eliminate the need for resistances of many different values, and further to eliminate the need for trimming or fine tuning of such resistances.

A further object of the present invention is to provide an electronic musical instrument wherein a sharp and a flat key are provided to select the tones in a musical selection which are other than seven major tones of A,B,C,D,E,F and G.

A still further object of the present invention is to provide an electronic musical instrument which is portable, simple to operate, and requires a minimum of adjustments to make the instrument properly operable.

These and other objects and advantages of the present invention will become more clear upon reference to the accompanying drawings and the following description.

DESCRIPTION OF A PREFERRED EMBODIMENT

Figure 1:
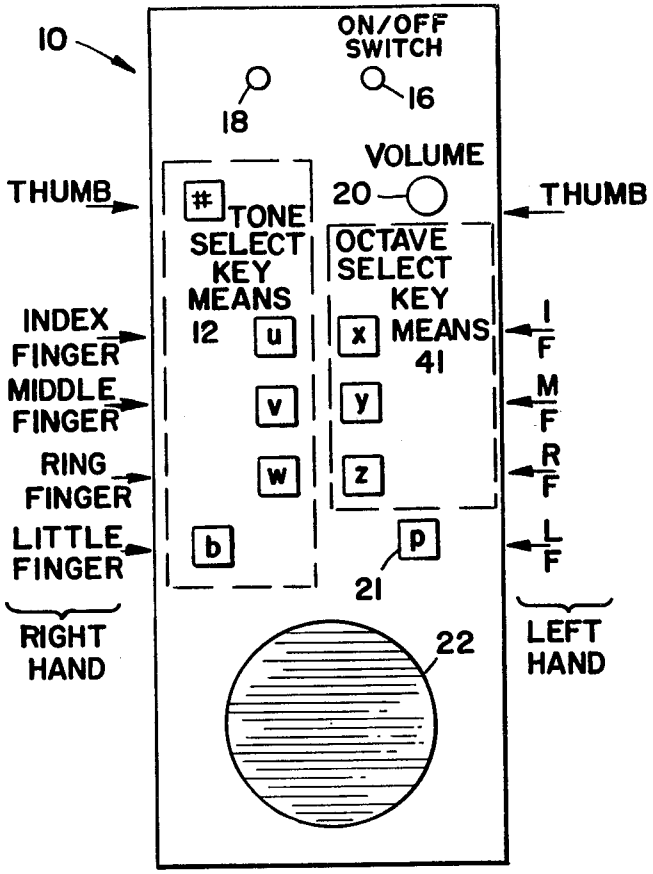
FIG. 1 is a front plan view of a musical instrument according to the present invention.

A front plan view of the electronic musical instrument of the present invention is shown at 10 in FIG. 1. The present invention includes tone select key means 12 and octave select key means 41. The tone select key means 12 includes three keys, keys U, V, and W, for enabling the manual selection of one of seven major tones in a standard octave interval. A sharp and a flat key, keys # and b, provide means for selecting the rest of the twelve tones in a standard keyboard octave interval. The octave select means 41 includes three keys, keys X, Y and Z for enabling the manual selection of one of a plurality of octave intervals within which frequency interval said selected tone will be generated. Note that in an alternate embodiment, the above manually selectable keys can be replaced by electronic signals generated by other means, for selection of tone and octave thereby.

The front view 10 of the electronic musical instrument also includes an on-off switch 16, an on-off indicator light 18 and a volume control 20. A pause key 21, key P, is also included for enabling the manual interruption of the sound output of the musical instrument when a tone has been manually selected by the tone select key means 12. Lastly, a speaker means 22 is provided so that audible sounds are produced from the audio signal generated by the electronic musical instrument of the present invention.

The present invention is designed to be portable and held in the two hands of the instrument operator, as shown in FIG. 1. The instrument can be powered with AC power, but since portability is desired, conventional powering of the apparatus with a battery (not shown) is preferred.

Figure 2:
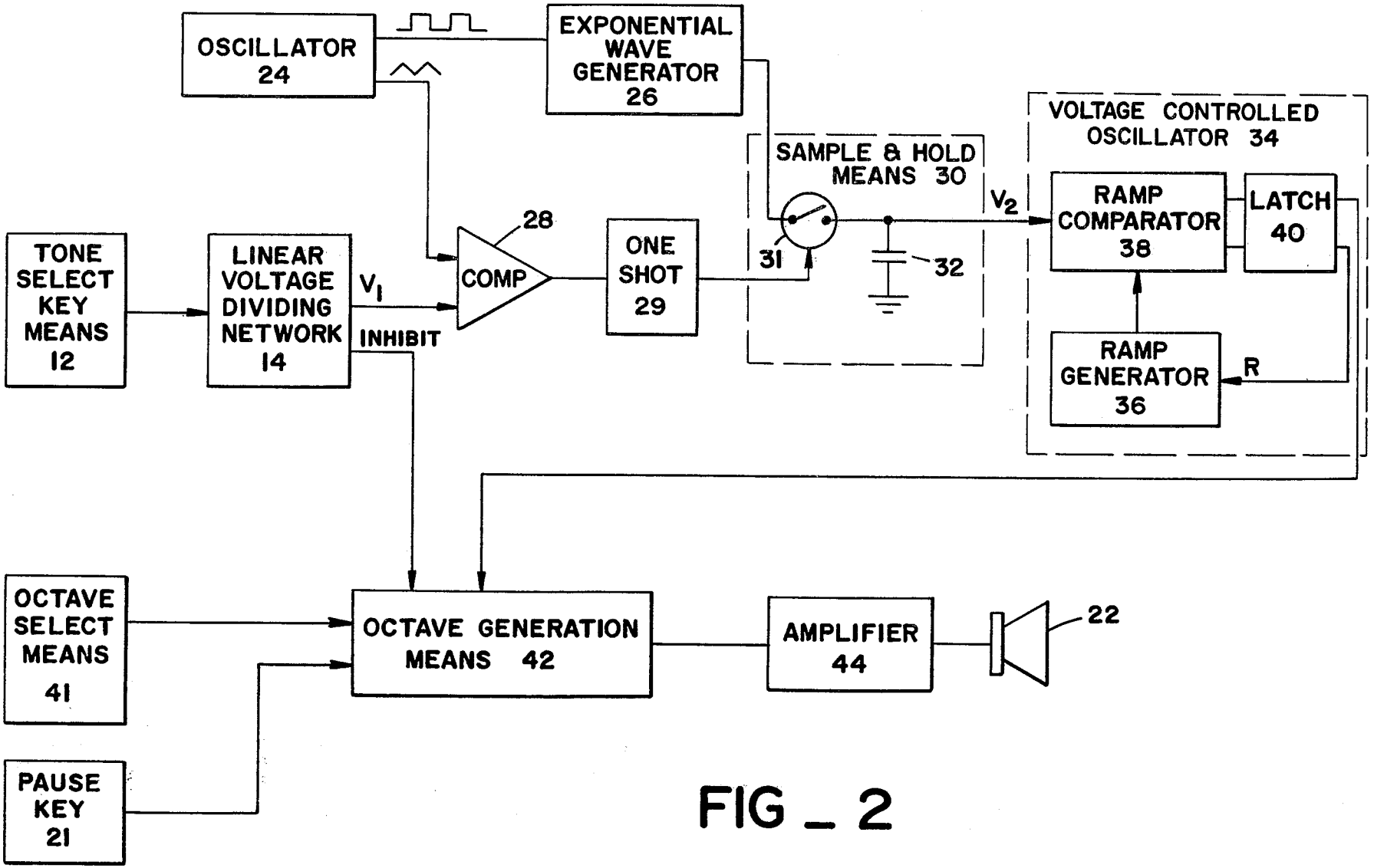
FIG. 2 illustrates a block diagram of the major components of the present invention.

FIG. 2 illustrates a schematic diagram of the major components of the present invention. To generate a musical tone, that tone is manually selected via the tone select key means 12. This selection is output to a linear voltage dividing network 14, which generates a first voltage signal, voltage $V_1$, as a function of the tone selected. This first voltage signal is designed to vary linearly as a function of the tone selected, so that it can be generated in a simple manner. In the present embodiment, said voltage is generated by means of a plurality of equal value resistance elements connected in series, by selectively outputting the voltage at a junction between adjacent resistance elements in said series string.

The first voltage signal is coupled to a means for generating a second voltage signal, voltage $V_2$, responsive to this first voltage signal, with said second voltage signal varying exponentially as a function of the linear variations of said first voltage signal. The means for generating a second voltage signal includes an oscillator 24, designed to output both a square and a triangular wave form, an exponential wave generator 26 for generating an output exponential wave as a function of the square wave output of oscillator 24, a comparator 28, a one shot 29, and sample and hold means 30, including an analog switch 31, and means for retaining said sampled voltage 32. The comparator 28 and one shot 29 function to output an impulse signal whenever the voltage of the triangular wave form output of oscillator 24 drops below the level of said first voltage signal. This impulse output of one shot 29 is used to activate analog switch 31 such that the output of exponential wave generator 26 is coupled therethrough, i.e. sampled, at that instant only. Note that the output triangle and square waves generated by oscillator 24 are synchronized, so that the output of exponential wave generator 26 is in synchronization with the output of the comparator 28 and one shot 29.

The sample and hold means 30 is provided to detect this sampled voltage, when it is coupled through the analog switch 31, and to hold this voltage at its output, by means of voltage retaining means 32. Thus, sample and hold means 30 outputs a voltage continuously as said second voltage signal, voltage $V_2$, until the sample and hold means 30 is again updated by the next closing of analog switch 31.

The second voltage signal is coupled to a voltage controlled oscillator 34, to provide means responsive to this voltage signal, for generating an audio frequency signal of the frequency of the selected tone. The voltage controlled oscillator 34 comprises a ramp generator 36, ramp comparators 38, and a latch 40. The output of ramp generator 36 is compared by the ramp comparators 38 to cause latch 40 to set when the ramp generator output voltage increases to or surpasses the voltage level of said second voltage signal. When the latch 40 changes to its set state, it causes the ramp generator 36 to reset. The ramp generator output thereafter goes low, to equal or fall below a reference voltage, causing said ramp comparators 38 to reset latch 40 after a short increment of time. This enables said ramp generator 36 to again begin to increase its output voltage towards the voltage held by the sample and hold means 30.

An octave generation means 42 is also included to provide means, responsive to the state of said octave select key means 41, for dividing the frequency of the audio frequency signal, as output by said latch 40, by one or more factors of two, to generate thereby an audio frequency tone in the selected octave interval. The output of octave generation means 42 is coupled to the speaker 22 via conventional audio amplifier means 44.

Figure 3:
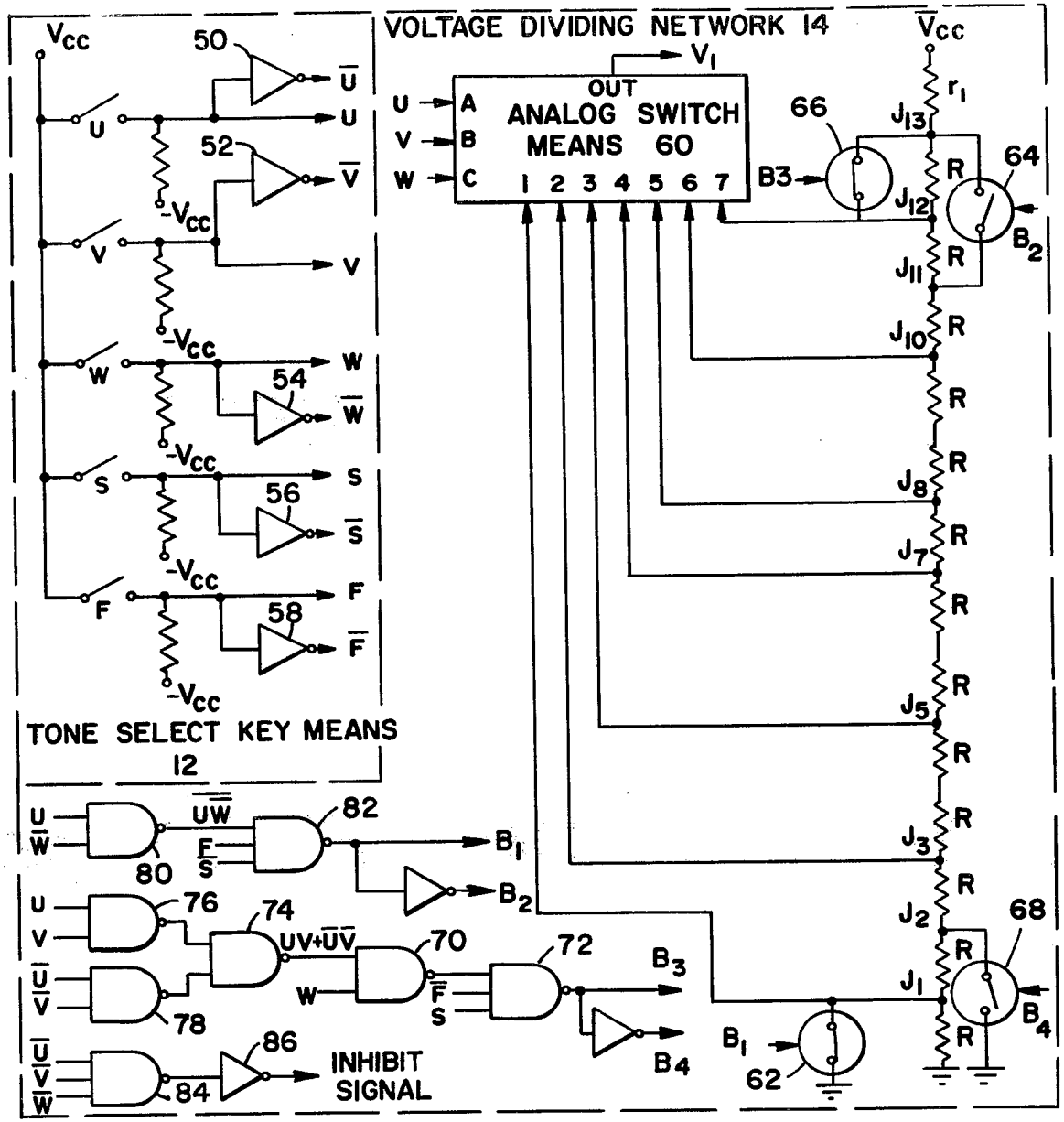
FIG. 3 is a schematic circuit diagram, partly in functional block diagram form, of the tone select key means and voltage divider network of the present invention.

Note that power supply voltages $+Vcc$ and $-Vcc$ are used to power the circuits of the present invention. These voltages are generated in a conventional manner from the power source available. Referring now more specifically to the operation of the components of the present invention, FIG. 3 illustrates a schematic circuit diagram of the tone select key means 12 and the voltage dividing network 14 of the present invention. As can be seen in FIG. 3, the voltage dividing network 14 includes a plurality of resistance elements R connected in series, with each said resistance element R being substantially equal in value. The tone select key means 12 includes manual keys U, V, W, sharp, and flat, which generate output signals U, $\overline{U}$, V, $\overline{V}$ . . . etc., as shown. For example, if switch U is actuated, a digital circuit compatible high signal is output on the U line, and a digital low signal on the $\overline{U}$ line. The inverting function for each of these switches is provided respectively by inverter gates 50, 52, 54, 56, and 58.

The U, V, and W outputs of the tone select key means 12 are fed directly into analog switch means 60. The analog switch means 60 is responsive to the state of these tone select keys for causing the voltage at a selected one of a plurality of junctions between adjacent resistance elements to be output as the first voltage signal $V_1$. As mentioned above, the U, V, and W keys select one of the seven tones in a standard octave interval. Given below in Table I is a chart of the tones selected as a function of which key or keys are pressed:

TABLE I

| Tone | C | D | E | F | G | A | B |
|---|---|---|---|---|---|---|---|
| Keys Actuated | U | V | W | U<br>V | V<br>W | U<br>W | U<br>V<br>W |

To obtain the rest of the twelve tones in a standard octave interval, means are provided for modifying the selected junction voltage for a given combination of keys U, V, and W, such that sharp and flat tones are selected thereby. That is, the first voltage signal is modified to correspond to the next respective higher or lower tone, when such a modification would thereby emulate the same corresponding sharp or flat tone selectable on a standard musical keyboard. The means for modifying the selected junction voltage comprises a plurality of bypass switches 62, 64, 66 and 68, which are operatively connected to selected ones of said resistance elements R, such that actuation of any one of said switches eliminates the effect of the resistance of such connected resistance element in said resistance series.

A plurality of NAND gates are also provided to provide means for selectively controlling the state of said bypass switches as a function of the actuation of the sharp or flat key, and as a function of the state of said tone select keys. Bypass switch 62 is connected between junction $J_1$ and system ground. Bypass switch 68 is connected between junction $J_2$ and ground. Bypass switch 64 is connected between junctions $J_{11}$ and $J_{13}$, and bypass switch 66 is connected between junctions $J_{12}$ and $J_{13}$ on the series resistance string of voltage dividing network 14. Essentially, the function of the bypass switches 62, 64, 66, and 68 is to either increase by one the number n of resistance elements R affecting a selected junction J, in the case when the sharp key is actuated, or the number n of resistance elements appearing at a selected junction is decreased by one when the flat key is actuated. Since the resistance string also includes a resistor $r_1$ in series with the voltage source, the following relationship is established:

$$V_1 = \frac{(11 - n)\, R\, Vcc}{11R + r_1} \qquad (1)$$

where n is the number, between 0 and 11, of the selected one of twelve tones determined by the state of said tone select key means 12.

In a standard musical keyboard, each octave has 12 notes or tones. Seven of these tones are the major or "white key" tones, and five additional tones are the minor or "black key" tones. In a musical keyboard, the black keys are interspersed between adjacent white keys except between notes B and C and between notes E and F. Thus, if we begin with the note C as the first note, corresponding to n equals 0 in the above formula, the next higher note would be C sharp/D flat (n=1), then note D (n=2) and so on, with the last notes in the 12 note interval being A (n=9), A sharp/B flat (N=10), and note B (n=11). Thus, if note D is selected by keys U, V and W, for example, the first voltage output is at a voltage level corresponding to n=2. If subsequently the flat key is actuated, the bypass switches change state such that the resistance elements detected at the selected junction for the D note is caused to have one less resistance element effectively in series with that junction point, thereby reducing the first voltage signal level by one step, corresponding to n=1, i.e. D flat.

The means for selectively controlling the state of said bypass switches to provide the above relationship of $V_1$ to the resistance element R given in formula (1) is the gate network as shown in FIG. 3. The bypass switches 62, 64, 66 and 68 are controlled from said gate network via respective control lines $B_1$, $B_2$, $B_3$, and $B_4$. During normal operation, when neither the sharp nor the flat key is actuated, control line $B_1$ is normally high on "on", control line $B_2$ is normally low or "off", control line $B_3$ is normally high or "on", and control line $B_4$ is normally low or "off". Thus, bypass switches 62 and 66, as shown, are normally closed and bypass switches 64 and 68 are normally open. As a result, during normal operation, the resistance element between $J_1$ and ground, and the reference element $J_{12}$ and $J_{13}$, are shorted out thereby, so that they contribute essentially no additonal resistance to the series.

The means for emulating selection of a sharp key on a musical keyboard via and bypass switches is provided by the NAND gates mentioned above. When the sharp key is actuated, a next higher voltage step is desired except when notes B or E have been selected. As shown in Table I, these notes correspond to key selections of U, V, and W actuated or W actuated and U, V unactuated. The output of NAND gate 70 provides this binary logic function. NAND gate 72 is provided merely to ensure that the states of bypass switches 66 and 68 only change state when the sharp key is actuated and the flat key is not actuated and when other than the B and E tones are selected. As seen in FIG. 3, the binary logic function of gate 70 is disabled via this combining of the states of the output signals from switches U, V and W by means of NAND gates 74, 76 and 78.

The means for selectively controlling the state of the bypass switches as a function of actuation of the flat key is similarly generated to emulate the operation of a standard musical keyboard, in that no flat is generated when a C note or an F note is selected. Again referring to Table I, this occurs when the U key is actuated and the V and W keys are unactuated, or when he U and V keys are actuated and the W key is unactuated. Since the only difference in key actuation of U, V, and W between notes C and F is the state of key V, this key state is irrelevant to the determination of when either of the two said notes have been selected. Thus, the only state needing detection is when the U key is actuated and the W key is unactuated. This function is generated by NAND gate 80. Again, NAND gate 82 is provided to insure that the states of bypass switches 62 and 64 remain unchanged unless both the flat key has been actuated and the sharp key is unactuated, and when other than the C and F tones are selected.

As will be discussed in more detail hereinbelow, an inhibit signal is also generated as a function of the state of the keys U, V and W. This signal is used to disable output audio sounds from being generated by said speaker means 22 when none of said tone select keys are manually selected. The function is generated by means of NAND gate 84 which conventionally detects when all of keys U, V, and W are in their "off" state. The output of NAND gate 84 is inverted via inverter 86 to generate the inhibit signal.

Figure 4:
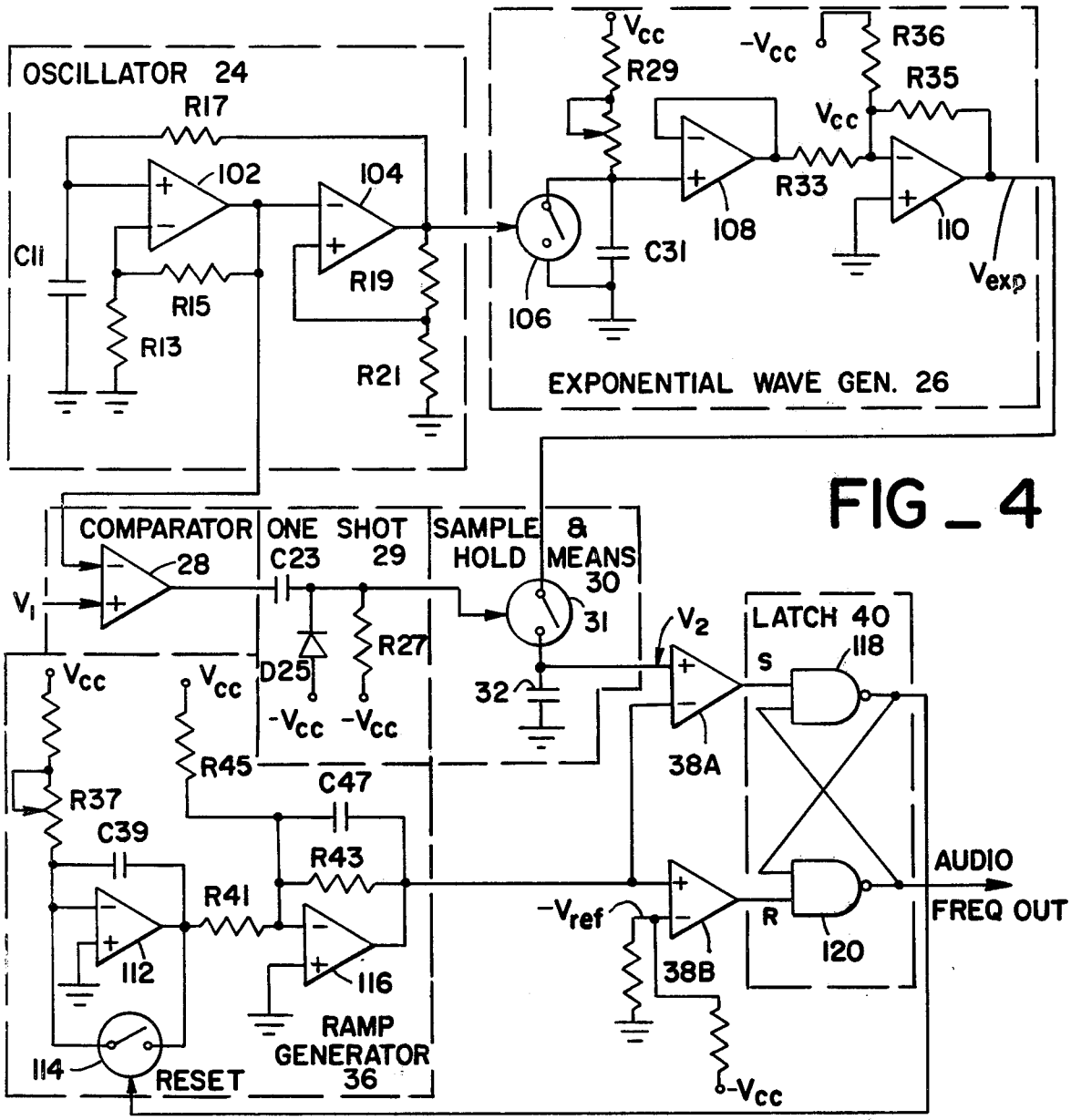
FIG. 4 is a schematic circuit diagram, partly in functional block diagram form, of the means for generating an exponentially variable voltage from the linear voltage generated by said voltage divider network.

Referring now to FIG. 4, as described above, said first voltage $V_1$ is modified by means of oscillator 24, exponential wave generator 26, comparator 28, one shot 29, and a sample and hold means 30, including an analog switch means 31 and a voltage retaining means 32, to generate a second voltage $V_2$ which varies exponentially as a function of the linear variations in the level of voltage $V_1$.

Oscillator 24 comprises a conventional two operational amplifier oscillator circuits, including amplifiers 102 and 104, and including biasing elements $C_{11}$, $R_{13}$, $R_{15}$, $R_{17}$, $R_{19}$, and $R_{21}$. The output of amplifier 102 is a triangular waveform which is coupled to comparator 28. The output of amplifier 104 is a square wave and it is coupled out to the exponential wave generator 26.

The comparator 28 is a conventional comparator unit which functions to change its output state from a low to a high level whenever the voltage level at its negative input drops below the voltage level appearing at its positive input. As seen in FIG. 4, the positive input of comparator 28 is the voltage $V_1$ generated by said voltage dividing network 14. Thus, when the signal from oscillator 24 drops below $V_1$, the output of comparator 28 goes high. This output is coupled to one shot 29 which functions to detect this positive going edge of the comparator 28 output. One shot 29, in response to this positive going edge, outputs an impulse signal to analog switch 31 in the sample and hold means 30. The one shot 29 comprises a capacitor $C_{23}$, a diode $D_{25}$, and a resistor $R_{27}$, connected in a conventional manner.

The square wave output of oscillator 24 is fed to an exponential wave generator 26. The slope of the exponential wave output by the exponential wave generator 26 is controlled by resistance $R_{29}$ and capacitance $C_{31}$. An analog switch 106, positioned to short out $C_{31}$ when switch 106 is actuated, insures that an output is generated from the wave generator 26 only when the square output of oscillator 24 is low. This is to ensure that the output of the wave generator 26 is falling exponentially only during the same time that comparator 28 detects the dropping of the voltage of the triangular wave output of oscillator 24 below the level of the first voltage signal $V_1$.

The components $R_{29}$ and $C_{31}$ feed an amplifier 108, whose output is an exponential wave. This is fed into a conventional inverting and shifting amplifier 110 which shifts the inverted exponential voltage by $V_{cc}$-$V_{ref}$. Amplifier 110 includes biasing elements $R_{33}$, $R_{35}$, and $R_{36}$, thereby generating the output exponential wave which is fed to analog switch 31.

As described above, the voltage level of the exponential wave generated by said generator 26 is coupled across analog gate 31 for an instant when said analog gate 31 is actuated by one shot 29. It is clear that the time during which said analog switch is closed must be short with respect to the frequency of the oscillator 24 so that the 12 distinct voltage levels desired, one for each selectable tone in said musical instrument, are readily detectable across said analog switch 31.

The means for retaining said voltage as it is coupled out from the analog switch 31 comprises a conventional capacitor, shown at 32 in FIG. 4. The capacitor 32 value is selected such that for the time duration between each voltage updating of said capacitor 32 via analog gate 31, only a slight discharging of said capacitor 32 is experienced. Consequently, said capacitor 32 acts as a retaining means to retain the present voltage level as input to it.

As mentioned above, a voltage controlled oscillator 34 provides means responsive to voltage signal $V_2$ for generating an audio frequency signal of the frequency of the selected tone. The voltage controlled oscillator 34 includes an operational amplifier 112 biased to generate a decreasing voltage at its output whose slope is a function of the value of a variable resistor $R_{37}$ and capacitor $C_{39}$. The output of this ramp generator amplifier 112 is coupled to a conventional voltage shifting amplifier 116 for outputting to the comparators 38A and 38B. Conventional biasing elements $R_{41}$, $R_{43}$, $R_{45}$, and $C_{47}$ are associated with amplifier 116.

In operation, comparator 38A is designed to generate a low output when the ramp signal from said ramp generator 36 exceeds said second voltage $V_2$. This causes the latch 40 to change to its set state, causing thereby the ramp generator 36 to be reset. The means for resetting the ramp generator 36 include an analog switch 114 operatively connected to said amplifier 112 such that when said latch 40 is in a set state, analog switch 114 is actuated to thereby short out capacitor $C_{39}$ across said ramp generating amplifer 112. This shorting out of amplifier 112 causes the ramp generator 36 output to quickly fall to or below a reference voltage, $-V_{ref}$, which is coupled to comparator 38B along with said ramp generator 36 output. The comparator 38B is designed to generate a low output when this condition is sensed. When comparator 38B goes low, latch 40 is caused to reset, thereby reenabling the ramp generator 36 to begin generating a new ramp generator 36 ramp signal output.

As can be seen in FIG. 4, the latch 40 includes a conventional connection of two NAND gates 118 and 120 to generate the latching function. Note also that the output of NAND gate 120 comprises the audio frequency output of the voltage controlled oscillator 34. This is because the switching frequency of latch 40 is directly a function of the level of voltage $V_2$ appearing at the input to comparator 38A.

Figure 5:
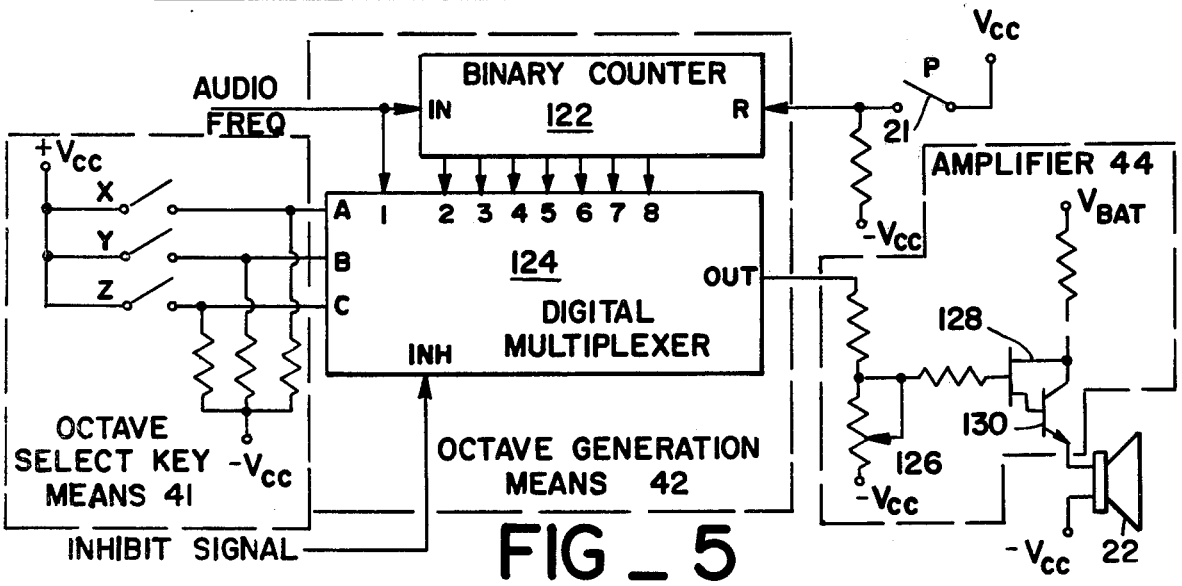
FIG. 5 is a schematic circuit diagram, partly in functional block diagram form, of the octave generation means and audio output circuit of the present invention.

FIG. 5 is a schematic circuit diagram of the octave generation means 42 and audio output circuit of the present invention. The octave generation means 42 includes a multi-stage binary counter 122 which counts the audio frequency signal which is input thereto. The binary counter 122 has a plurality of counter stages, including an output signal path associated with each said stage, so that each stage of the counter can be independently sensed.

These output stage signal paths are coupled to a digital multiplexer 124. The digital multiplexer 124 outputs an audio frequency signal to the speaker 22 which comprises one of said plurality of output signal paths, as a function of the state of the octave select key means 41. This means 41 includes three manually selectable octave keys X, Y, and Z. The output of these keys are operatively connected to the digital multiplexer 124, to thereby selectively enable onw of said binary counter 122 output stages to be operatively coupled out of the digital multiplexer 124.

Since each subsequent counter stage of the binary counter 122 acts to divide the input audio frequency signal by a factor of 2, the selection of one of said output stages of binary counter 122 by means of the octave select key means 41 and digital multiplexer 124, results in the ability to selectively output the audio frequency tone in any one of eight desired octave intervals.

Note that the pause key 21 is also input to the binary counter 122 reset input. The pause key 21 acts to disable further counting of binary counter 122 when the pause key is actuated, so that temporary interruption of a specific selected tone can be maintained during such an actuation, without requiring that the specific tone selection be modified in the tone select key means 12. Further, the inhibit signal is coupled to the digital multiplexer 124's inhibit input. Consequently, when this signal is high, it causes the digital multiplexer 124 to prevent any output signal from emanating therefrom. Thus, when no tone is selected, i.e. none of the keys U, V or W are actuated, no tone is output by the speaker 22. This feature both prevents annoying noise from being possibly generated when no tone select keys are actuated, and also serves the purpose of saving power consumption when the musical instrument of the present invention is turned on but is not being played.

Finally, the output of digital multiplexer 124 is fed to speaker 22 via a conventional power amplifier 44. This amplifier includes volume adjustment means 126 operatively connected to the volume control knob 20 on the front of the musical instrument of the present invention. Amplifier 44 also includes a FET 128 and transistor 130 coupled as an emitter follower to the speaker 22. Note that the speaker 22 is powered from the battery voltage rather than from $V_{cc}$, since regulated power is not required by the speaker 22.

Theory of Operation

It is well known that the frequency of a tone in a standard keyboard octave interval is twice that of the same tone in the next lower octave interval. For example, the frequency of the A tone in a standard musical instrument of one octave level is 200 Hz. In the next higher octave interval the frequency of the same tone is 440 Hz. Similarly, it is also well known that the frequency of the 12 tones in an octave interval is a function of the frequency of the first tone in the interval $f_1$ multiplied by an exponential factor as follows:

$$f_n = F_1 \cdot 2^{n/12} \text{ Tm} \quad (2)$$

wherein n is the number of the tone in steps above the reference tone $f_1$.

From the above formula (2) it can be seen that the various tones in an octave interval are exponentially, rather than linearly related. Thus, in the musical instrument of the present invention, the 12 linear voltage levels defind for the first voltage signal $V_1$ are converted into an exponentially variable voltage $V_2$, variable again in 12 steps.

Figure 6:
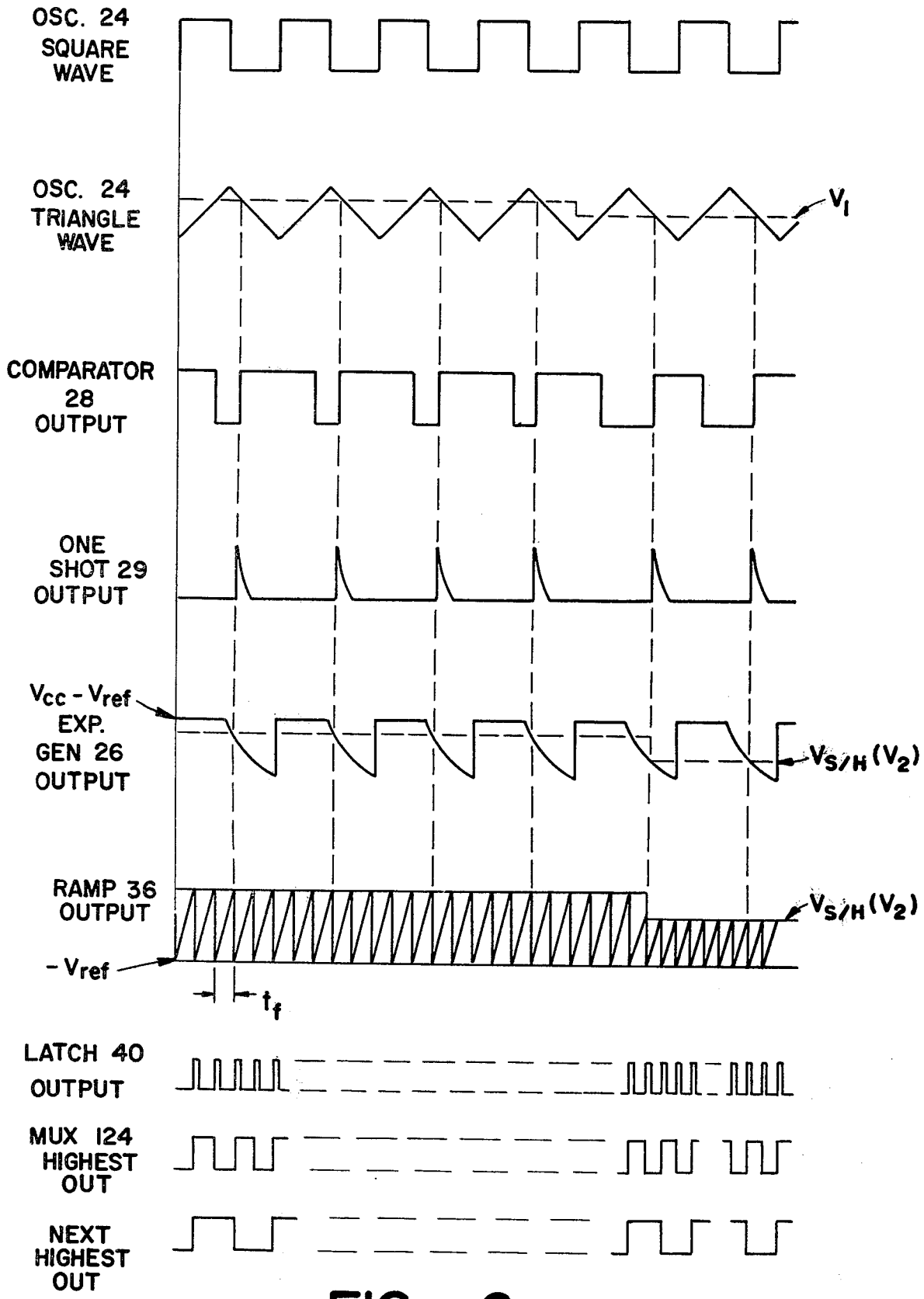
FIG. 6 illustrates a timing diagram showing the operation of the present invention.

FIG. 6 illustrates a timing diagram showing the operation of the present invention. The first two curves shown in the timing diagram are the square and triangular wave outputs of oscillator 24. The critical portion of the triangle wave is the negative going portion of the triangular wave. The slope "a" of the negative going triangular wave is determined by the values of $R_{13}$, $R_{15}$, $R_{17}$, and $C_{11}$. One can see that the maximum voltage of this wave, voltage $V_x$, is initially defined to be a voltage equal to or greater than the maximum voltage obtainable from the voltage dividing network 14. This would be the voltage of $J_{13}$. Thus, at time t, the voltage of the triangular wave equals the first voltage $V_1$ generated by the voltage dividing network 14, so that:

$$t_1 = 1/a\,(V_x - V_1) \quad (3)$$

where a is the negative going slope of the triangle wave.

Additionally, the exponential relation generated by the exponential wave generator 26 is of the form:

$$V_{exp.} = V_{cc}\, e^{-t/t} \text{ exp.} - V_{ref} \quad (4)$$

Now since, as seen in FIG. 6, the output of comparator 28, and thus the one shot 29 output impluse, occurs in synchronization with the generation of the exponential wave by the exponential generator 26, the t in the above equation (4) is equal to $t_1$. Thus, substituting equation 4 into equation 3 and then into formula 1 given hereinbefore, we get the following relation:

$$V_2 = V_{cc}\, e^{\frac{-(V_x - V_1)}{a\, t_{exp.}}} - V_{ref} = V_{cc}\, e^{\frac{-n\, R\, V_{cc}}{a\, t_{exp.}\,(11R + r_1)}} - V_{ref} \quad (5)$$

where $V_x$ is chosen to be equal to or slightly greater than $V_{cc}$ (11R/11R+$r_1$). Note that the ramp generator output voltage varies between $V_2$ and $-V_{ref}$, the reference voltage at the inverting input of comparator 38B.

The frequency of the ramp generator 36 output is similarly expressible as folllows:

$$f = 1/t = b/(V_2 - (-V_{ref})) \quad (6)$$

where b equals the slope of the ramp, and is defined by the values of $R_{37}$ and $C_{39}$.

Thus, substituting equation (5) into equation (6), we get the following:

$$f = b/V_{cc}\, e^{\frac{n\, R\, V_{cc}}{a\, t_{exp.}\,(11R + r_1)}} \quad (7)$$

Finally, since we want to get equation (7) in the form of equation (2), we need merely let $f_1$ equal $b/V_{cc}$ and set:

$$2^{n/12} = e^{\frac{n\, R\, V_{cc}}{a\, t_{exp.}\,(11R + r_1)}} \quad (8)$$

This implies, therefore, $$t_{exp.} = \frac{12\, R\, V_{cc}}{a\,(11R + r_1)\ln 2} \quad (9)$$

Thus, since $t_{exp.}$ is defined by the value of $R_{29}$ and $C_{31}$ in the exponential wave generator 26, by adjusting the value of $R_{29}$, the exponential relationship of $2^{1/12}$ can be easily achieved. Similarly, $f_1$ can be set to the frequency of the C tone in the highest octave easily by means of adjusting $R_{37}$ in the ramp generator 36. Thus, there are only two adjustments required in the circuit of the present invention to obtain proper operation thereof: the adjusting of $R_{29}$ in the exponential wave generator 26; and the adjustment of $R_{37}$ in the ramp generator 36. Consequently, the technical experience required to initially set up the circuit is minimized.

It is to be understood that the foregoing description is merely illustrative of a preferred embodiment of the invention and the scope of the invention is not to be limited thereto, but is to be determined by the scope of the appended claims.

I claim:

1. An electronic musical instrument comprising:

tone select key means for enabling selection of one of twelve musical tones in a given octave interval, and including a sharp and a flat key;

a voltage dividing network for generating a first voltage signal corresponding to a selected said tone, said first voltage signal varying linearly as a function of the tone selected, said voltage dividing network comprising:

(i) a plurality of resistance elements connected in series, said resistance elements being substantially equal in value;

(ii) analog switch means responsive to the state of said tone select key means for causing the voltage at a selected one of a plurality of junctions between adjacent resistance elements to be output as said first voltage signal;

(iii) means for modifying said selected junction voltage as a function of the manual selection of said sharp or flat key, such that said first voltage signal is modified to correspond to the next respective higher or lower tone, when such a modification would thereby emulate the same corresponding sharp or flat tone selectable on a standard musical keyboard;

means for generating a second voltage signal responsive to such first voltage signal, said second voltage signal varying exponentially as a function of said first voltage signal;

means responsive to said second voltage signal for generating an audio frequency signal of the frequency of the selected tone; and speaker means for generating a sound signal from said audio frequency signal.

2. The electronic musical instrument of claim 1 further comprising:

octave select key means for enabling selection of one of a plurality of output octave intervals for said selected tone;

octave generation means responsive to the state of said octave select key means for dividing the frequency of said audio frequency signal by one or more factors of 2 as a function of the octave selected, to generate thereby said tone in said selected octave interval.

3. The electronic musical instrument of claim 2, wherein said octave generation means comprises:

multistage binary counter means having said audio frequency signal input thereto, and including an output signal path for each stage of said counter; and means for selectively outputting the output signal of a selected stage of said counter as a function of the state of said octave select key means.

4. The electronic musical instrument of claim 3, wherein said means for selectively outputting the signal path of a selected stage of said counter comprises a digital multiplexer.

5. The electronic musical instrument of claim 2 further comprising means in combination with said voltage dividing network and said octave generation means for inhibiting any output tone when said tone select key means is not being manually selected.

6. The electronic musical instrument of claim 1, wherein to generate said first voltage signal, said resistance elements R cooperate with said analog switch means and said means for modifying said selected junction voltage substantially according to the following relationship, including a voltage source $V_{cc}$ and a resistor biasing element $r_1$:

$$V_1 = \frac{(11 - n)\, R\, V_{cc}}{11R + r_1}$$

where n is the number, between 0 and 11, of the selected one of 12 tones determined by the state of said tone select key means.

7. The electronic musical instrument of claim 1, wherein said tone select key means comprises three manual tone select keys, said keys being decoded by said analog switch means to selectively output the voltage at one of seven junctions between adjacent resistance elements corresponding to the seven major tones in a musical octave, and wherein said means for modifying said selected junction voltage as a function of the manual selection of said sharp or flat key comprises:

(i) a plurality of bypass switches operatively connected to selected ones of said resistance elements such that actuation of any one of said switches eliminates the effect of the resistance of such connected resistance element in said series; and (ii) means for selectively controlling the state of said bypass switches as a function of the actuation of said sharp or flat key and as a function of the state of said tone select keys.

8. The electronic musical instrument of claim 1, wherein said means for generating a second voltage signal exponentially responsive to said voltage signal comprises:

an oscillator including square and triangle wave form output signals:

comparator means for outputting a signal when said triangle wave drops below a threshold voltage equal to said first voltage signal;

means for generating a one-shot pulse, having a short duration with respect to the frequency of said oscillator, in response to said comparator means output signal;

exponential wave generation means responsive to said oscillator square wave; and sample and hold means, including means responsive to said one-shot pulse for causing the momentary coupling of the output of said exponential wave generation means to said sample and hold means, such that the output of said sample and hold means comprises said second voltage signal.

9. The electronic musical instrument of claim 1, wherein said means responsive to said second voltage signal for generating an audio frequency signal of the frequency of the selected tone comprises:

first and second ramp comparators;

latch means, the output of which comprises said audio frequency signal, ramp generation means including means responsive to the set state of said latch for resetting said ramp generator means, said second voltage signal and the output of said ramp generator means being coupled to said first comparator, said first comparator generating a output signal when the voltage of said ramp generator output increases to or surpasses said second voltage signal, said latch means being caused to be set in response thereto, the output of said ramp generator and a reference voltage being coupled to said second comparator, said second comparator generating an output signal when the voltage of said ramp generator output equals or drops below said reference voltage, said latch means being caused to be reset in response thereto.

10. The electronic musical instrument of claim 1, further comprising pause key means for enabling the manual interruption of said sound signal when one of said tones has been manually selected by said tone select key means.

* * * * *

UNITED STATES PATENT OFFICE
CERTIFICATE OF CORRECTION

Patent No. 4,170,160 Dated October 9, 1979

Inventor(s) Jong Guo

It is certified that error appears in the above-identified patent and that said Letters Patent are hereby corrected as shown below:

In Column 1, line 7, change "piano-key" to --piano-type--.

In Column 4, line 5, between "enables" and "said" insert --thereby--.

In Column 5, line 37, change "(N=10)" to --(n=10)--.

In Column 5, line 61, change "reference element" to --resistance element between--.

In Column 5, line 63, change "additonal" to --additional--.

In Column 5, line 65, change "and" to --said--.

In Column 6, line 18, change "he" to --the--.

In Column 6, line 51, change "circuits" to --circuit--.

In Column 7, line 10, after "square" insert --wave--.

In Column 8, line 31, change "onw" to --one--.

In Column 9, line 7, change "200" to --220--.

In Column 9, line 14, change "$f_n = F_1 \cdot 2^{n/12}\ T_m(2)$" to --$f_n = f_1 \cdot 2^{n/12}$--.

UNITED STATES PATENT OFFICE

CERTIFICATE OF CORRECTION

Patent No. 4,170,160 Dated October 9, 1979

Inventor(s) Jong Guo

It is certified that error appears in the above-identified patent and that said Letters Patent are hereby corrected as shown below:

In Column 9, line 22, change "defind" to --defined--.

In Column 9, line 36, change "of $J_{13}$" to --at $J_{13}$--.

Signed and Sealed this

*Twenty-fifth* Day of *March 1980*

[SEAL]

*Attest:*

SIDNEY A. DIAMOND

*Attesting Officer*

*Commissioner of Patents and Trademarks*